United States Patent [19]

Kendall

[11] 4,384,655

[45] May 24, 1983

[54] PRESSURIZED VESSEL HAVING CLOSURE SAFETY MEANS

[76] Inventor: Julius Kendall, 57 Colchester, Weston, Mass. 02193

[21] Appl. No.: 348,407

[22] Filed: Feb. 12, 1982

[51] Int. Cl.[3] ..... B65D 45/00

[52] U.S. Cl. ..... 220/316; 220/256; 220/284

[58] Field of Search ..... 220/256, 284, 316, 367; 137/377, 322, 212; 138/30, 243

[56] References Cited

U.S. PATENT DOCUMENTS 4,122,969 10/1978 Hughey ..... 220/256

4,343,325 8/1982 Fallon ..... 220/316

*Primary Examiner*—George T. Hall

*Attorney, Agent, or Firm*—Leon J. Bercovitz

[57] ABSTRACT

A vessel includes a body having a chamber normally containing pressurized gas and enclosed by a removable closure provided with a gas charging valve. Inadvertent disassembly of the closure when the chamber contains pressurized gas is precluded by a planar cover plate captively retained by the charging valve and normally masking tool-receiving members on the closure. Removal of the valve/cover plate unit initially releases a resilient seal carried by the inner face of the valve juxtaposed the outer face of the closure and subsequently progressively exposes to the atmosphere a gas bleeding passage formed in the attachment stem of the valve to gradually release all pressurized gas from the vessel chamber. The closure is only accessible for disassembly following complete removal of the unitary valve and cover plate after which all gas under pressure in the chamber has been relieved.

6 Claims, 5 Drawing Figures

PRESSURIZED VESSEL HAVING CLOSURE SAFETY MEANS

This invention relates generally to pressurized vessels and more particularly to an improved construction leading to enchanced safety during disassembly of the vessel.

Pressurized vessels, such as an accumulator of the hydropneumatic type, include a body or cylinder containing a reciprocating piston which acts against a body of incompressible fluid on one face and a compressible fluid such as air on its other face. The chamber containing this compressible fluid is bounded by the reciprocating piston and a removable closure or cylinder head. Before the vessel is put into operation, means are provided to precharge the gas chamber by the introduction of gas under a substantial pressure and accordingly, it is desired that means be provided to safely remove this pressure before disassembly or removal of the gas chamber closure.

Individuals skilled in the art are well aware of the dangers involved when such a vessel closure is removed before the gas precharge has been eliminated. Gas charging valves are provided for introducing the precharge gas through the cylinder head and into the gas chamber and many pressurized vessels are clearly placarded to warn maintenance personnel to relieve the precharge pressure before attempting removal of the vessel closure. Nevertheless, many instances are known wherein a gas chamber closure has been loosened without relieving the precharged pressure, with serious physical injury resulting. In some cases, the components of the charging valve have become jammed and the operator abandoned any further effort to relieve the precharge pressure before proceeding to remove the gas chamber closure.

By the present invention, an improved construction is provided wherein a gas charging valve incorporates an integral coextensive cover plate such that when the charging valve is properly installed with respect to the chamber closure, the affixed cover plate substantially fully overlies the outer face of the chamber closure and completely masks tool-receiving means on the chamber closure which must be accessible before the closure can be loosened or removed from the body of the pressurized vessel. In this manner, it is impossible to gain access to the gas chamber closure for its removal until the cover plate has been entirely removed therefrom and in view of the integral nature of the gas charging valve and cover plate, it will be apparent that the valve must likewise be removed from the gas chamber closure before the closure can be disassembled. It is this total removal of both the valve and cover plate that insures complete dissipation of the precharge gas within the vessel since means are included in the gas charging valve to safely and automatically allow dissipation of the precharge gas during removal of the valve and cover plate as a single unit.

Cover plates as such are, of course, well known in pressurized vessels. U.S. Pat. No. 3,961,179 issued June 1, 1976 to Zahid, discloses a charging valve in the closure of a pressurized vessel. The cover plate in this earlier patent overlies or masks tool-receiving means in the outer face of the closure but lacks any fixed attachment with the charging valve and thus the Zahid cover plate can be individually removed following which the closure may be removed without any insurance that the gas precharge has been properly relieved. A similar circumstance exists in the patent to Mercier U.S. Pat. No. 3,319,420 issued May 16, 1967 wherein a locking plate surrounds an air inlet through the head of a pressure vessel and normally overlies tool receiving means but again, no means are inclined for insuring safe release of precharged gas before manipulation of the locking plate.

Accordingly, one of the objects of the present invention is to provide an improved pressurized vessel having a removable gas chamber closure which in turn is provided with a gas charging valve integrally attached to a cover plate normally substantially coextensive with the outer face of the closure to preclude dissassembly of the closure from the vessel without the total removal of the charging valve/cover plate unit.

Another object of the present invention is to provide an improved pressurized vessel having a removable gas chamber closure provided with a unitary charging valve/cover plate with the charging valve provided with an attaching stem including gas bleeding means automatically operable upon removal of the charging valve/cover plate unit from the chamber closure.

Still another object of the present invention is to provide an improved pressurized vessel including a removable gas chamber closure removably receiving a charging valve/cover plate unit and wherein the cover plate is captively carried by the charging valve and revolvable with respect thereto.

A further object of the present invention is to provide an improved pressurized vessel having a removable gas chamber closure in turn removably receiving a charging valve/cover plate unit with the inner face of the charging valve that engages the outer face of the chamber closure containing an annular resilient sealing element.

With these and other objects in view which will more readily appear as the nature of the invention is better understood, the invention consists in the novel construction, combination and arrangement of parts hereinafter more fully illustrated and claimed.

The invention will be described further by way of example with reference being made to the accompanying drawings, in which.

Similar reference characters designate corresponding parts throughout the several figures of the drawings.

Figure 1:
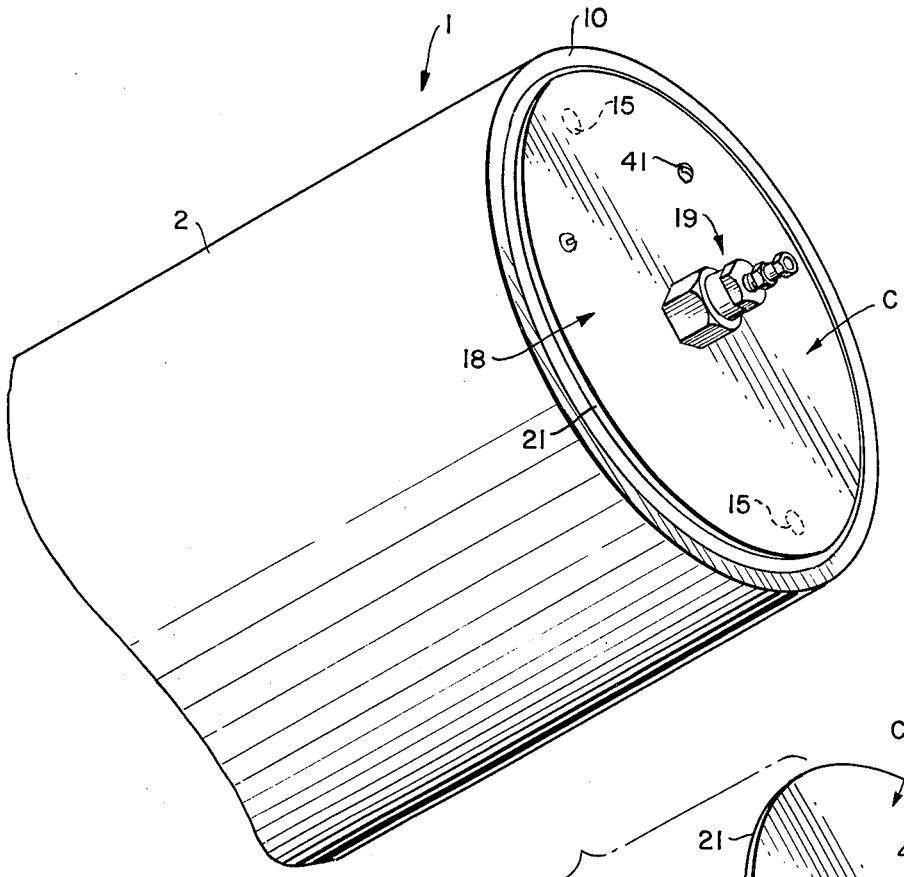
FIG. 1 is a partial perspective view of a pressurized vessel according to the present invention.
Figure 3:
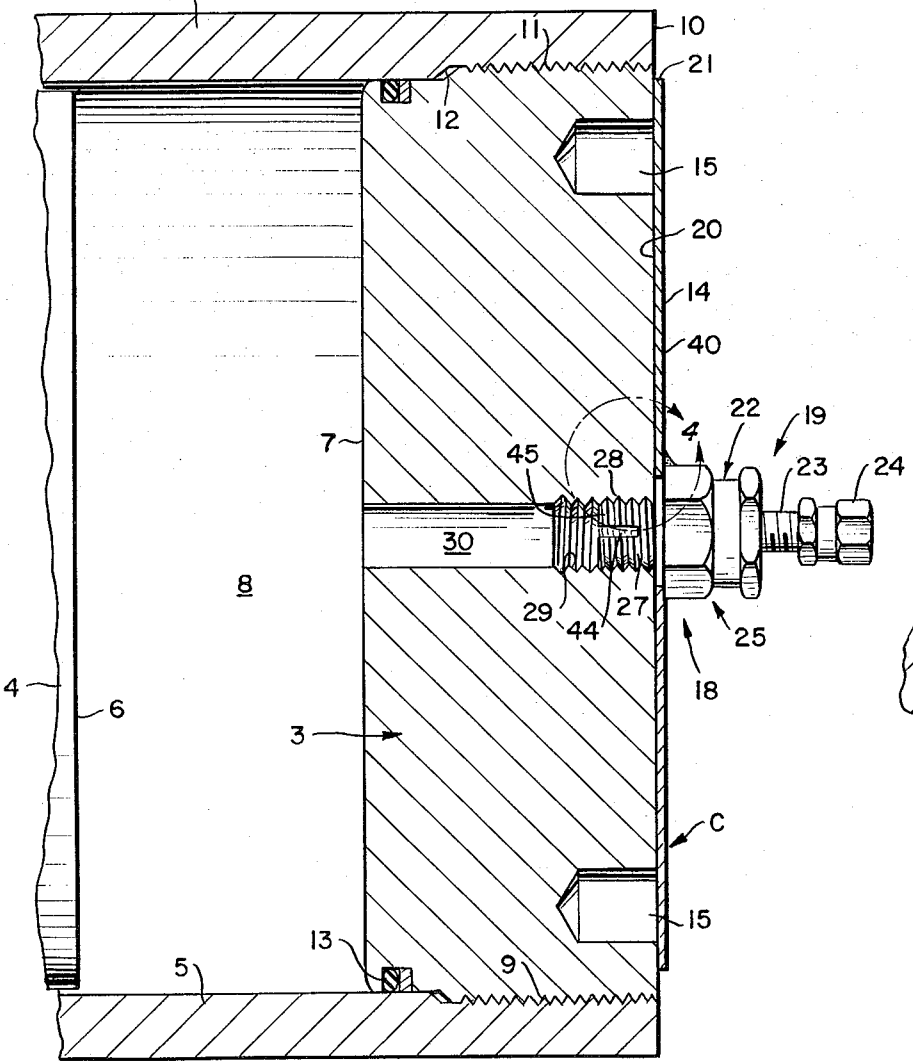
FIG. 3 is an enlarged vertical sectional view of the structure of FIG. 1.

Referring now to the drawings, particularly FIGS. 1 and 3, the present invention will be understood to relate to a pressurized vessel, generally designated 1, such as a hydropneumatic accumulator and which includes a cylindrical body or housing 2 bounded at one open end by means of a closure or head 3. As shown in FIG. 3 of the drawings, the interior of the body 2 includes a reciprocating piston 4 having appropriate sealing means (not shown) cooperating with the wall 5 of the cylinder 2. The illustrated face 6 of the piston 4 cooperates with the opposed inner face 7 of the stationary chamber closure 3 to define a gas chamber 8 therebetween. As is well known in the case of hydropneumatic accumulators, the opposite face of the reciprocating piston 4 will be acted upon by an incompressible fluid (not shown).

The gas chamber closure 3 must be provided with means enabling its ready removal for various obvious purposes such as initial assembly and subsequent disassembly for replacement thereof or servicing of other internal components of the vessel. Accordingly, the cylinder wall 5 of the body 2 is provided with internal threads 9 adjacent the end 10 of the body and which mate with cooperating external threads 11 on a substantial portion of the periphery of the gas chamber closure 3. Additional means may be provided to insure a proper seating of these components when fully assembled as shown in FIG. 3, such as the seating surfaces 12 and likewise, an appropriate seal 13 may be carried by the external periphery of the closure 3 adjacent its inner face 7 and which will be understood to tightly engage the cylinder wall 5.

Figure 2:
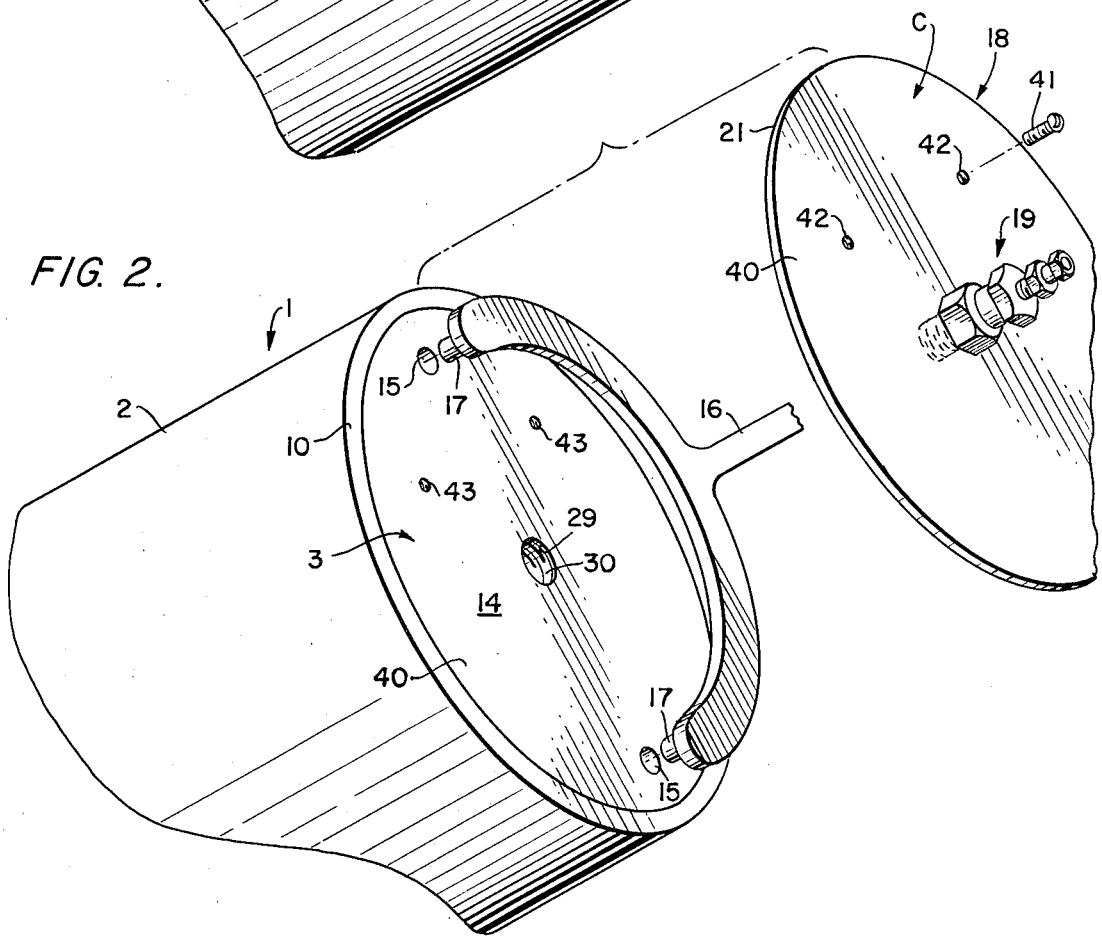
FIG. 2 is a partial perspective view of the vessel of FIG. 1 with the charging valve/cover plate unit shown in removed position.

The assembly of the above described components is readily accomplished by providing appropriate tool-receiving means in the outer face 14 of the gas chamber closure 3 such as the diametrically opposed wrench openings or sockets 15 whereby a well known tool such as the spanner wrench 16 shown in FIG. 2 may be employed. A conventional spanner wrench includes a pair of spaced apart tongue elements 17 adapted to be inserted within a pair of wrench openings 15 whereupon arcuate displacement of the spanner wrench 16 in opposite directions respectively produces a tightening or loosening of the cooperating work piece.

From the above description, it will be obvious that with the outer face 14 of the gas chamber closure 3 exposed as illustrated in FIG. 2 of the drawings, the closure 3 may be readily removed from the remainder of the pressurized vessel 1 and if this were to occur with the usual gas precharge contained within the chamber 8 therein, substantial injury could occur without the protective features offered by the present invention. To preclude the careless or inadvertent removal of the closure 3 from a pressurized vessel containing a precharge within the internal chamber 8, a unique charging valve/cover plate unit, generally designated 18, is provided. Details of this unit 18 are shown most clearly in FIGS. 3–5 of the drawings.

The unit 18 comprises a gas charging valve generally designated 19 and a captively retained cover plate C. In the assembled position as shown in FIG. 3 of the drawings, the inner surface 20 of the planar cover plate C will be seen to overlie the outer face 14 of the closure 3 with its peripheral or outer edge 21 disposed adjacent the body end 10 and thus fully masks the tool-receiving openings 15 so that loosening or removal of the closure 3 is not possible when the unit 8 is thusly disposed.

The gas charging valve 19 includes a central valve body 22 having an outermost filler stem 23 which may be protected by a suitable cap 24. The valve body is provided with a mounting base 25 which is formed with an appropriate polygonal periphery 26 readily lending itself to engagement with a wrench or other tool in order to manipulate the unit 18 as will be described hereinafter. The innermost end of the valve 19 is provided within an attachment stem 27 having external threads 28 engageable within internal threads 29 formed in an axial gas passage 30 extending through the gas chamber closure 3.

Figure 4:
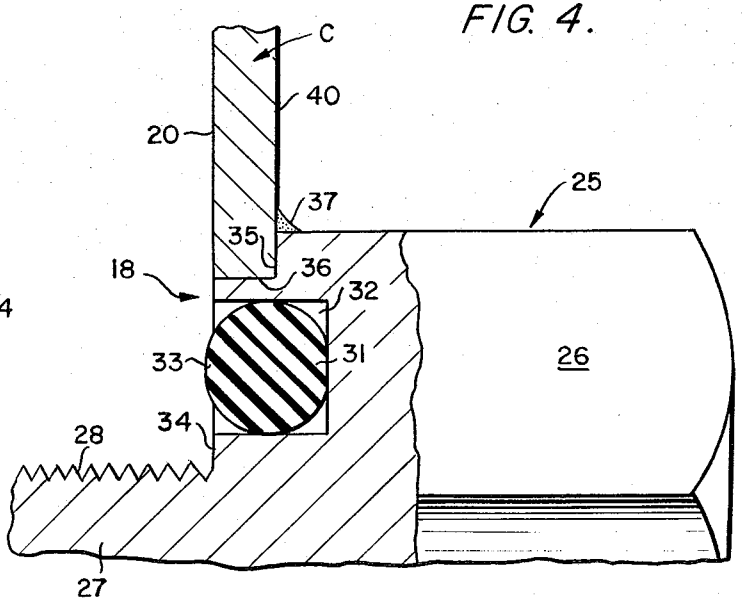
FIG. 4 is an enlarged fragmentary view, with portions in section, of the encircled area of FIG. 3.

The chamber 8 of the vessel 1 is precharged by removing the valve cap 24 and connecting to the valve stem 23 a source of pressurized gas which passes through a central bore (not shown) of the valve 19 and thence through the gas passage 30 to fill the gas chamber 8. To preclude the leakage of any gas which may pass through the mating threads 28,29 an annular, resilient sealing element 31 is carried by the valve mounting base 25 as shown in FIG. 4 of the drawings. This sealing element 31 is located within a concentric groove 32 and the relative configuration of the sealing element and groove is such that the periphery 33 of the sealing element noticeably extends beyond the planar face 34 of the valve mounting base 25 when the charging valve/cover plate unit 18 is not fully seated with respect to the vessel gas chamber closure 3. In this manner, it will be appreciated that when the unit 18 is fully installed with the coplanar cover plate inner surface 20 and valve inner face 34 abutting the closure outer face 14, the periphery 33 of the sealing element 31 will be forceably deflected to firmly engage the closure outer face 14 as portions of the normally cylindrical sealing element body are deformed into available spaces of the annular groove 32.

FIG. 4 of the drawings also illustrates one possible manner of insuring the captive retention of the cover plate C relative the gas charging valve 19. The valve mounting base 25 will be seen to be provided with a shouldered recess 35 communicating with valve inner face 34. The central portion of the cover plate is apertured to provide an inner periphery 36 which is disposed within the valve recess 35 such that the cover plate inner surface 20 is coplanar with the valve inner face 34 or at least, is disposed so that the cover plate inner surface 20 does not project rearwardly beyond the plane of the valve inner face 34. Suitable attachment means such as the weld 37 insures a rigid mounting between the two components of the unit 18.

Figure 5:
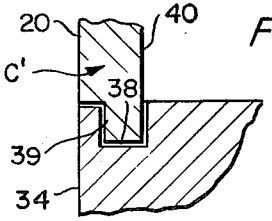
FIG. 5 is a vertical section view of a modified form of attachment of the cover plate to the charging valve.

FIG. 5 of the drawings illustrates an alternative attachment of the cover plate C' to the gas charging valve 19 wherein the valve mounting base 25 is provided with a peripheral channel 38 spaced away from the valve inner face 34 and adapted to receive a tongue 39 on the inner periphery 36 of the cover plate. This tongue 39 is likewise set back from the cover plate inner surface 20 and captively retains the assembly of the two components of the unit 18 while allowing of relative angular displacement therebetween.

The distinction between the attachment offered in the two embodiments of FIGS. 4 and 5 of the drawings, is that when the gas charging valve 19 of FIG. 5 is fully tightened with respect to the gas chamber closure 3, the cover plate C' may thereafter be angularly displaced. In certain installations, this feature may be desirable as it allows for orientation of the cover plate C' with respect to the pressurized vessel 1. The outer surface 40 of the cover plate may serve as a nameplate for the vessel and thereby may be imprinted with technical data, instructions or specifications, in which case it is most desirable that such indicia be properly orientated for viewing by the user. Accordingly, with the arrangement of FIG. 5, the cover plate C' may be rotated after the gas charging valve 19 is fully seated and the thus positioned cover plate anchored with respect to the vessel 1 by the application of appropriate fasteners 41 through one or more openings 42 in the cover plate and tapped holes 43 in the outer face 14 of the closure 3.

An important feature to note is that regardless of the means for captively retaining the cover plate with respect to the charging valve, the gas chamber closure 3 cannot be removed before the unit 18 is fully removed from the pressurized vessel. This removal of the unit 18 involves engagement of the mounting base periphery 26 with an appropriate tool in order to loosen the stem 28 of the valve with respect to the closure 3. This loosening initially causes the inner face 34 of the valve 19 to back away from the juxtaposed outer face 14 of the closure 3 thereby relieving the seal provided by the sealing element 31. Continued loosening of the valve 19 produces an outward axial displacement of a longitudinally extending passage 44 formed in the external threads 28 of the valve attachment stem 27. This longitudinal passage or slot 44 is shown in FIG. 3 of the drawings and comprises gas bleeding means extending axially from the innermost end 45 of the valve stem 27 to a point short of that end of the stem adjacent the valve mounting base 25.

With the above construction, it will be obvious that when the unit 18 is fully installed as shown in FIG. 3 of the drawings, those uninterrupted threads 28 immediately adjacent the inner face 34 of the valve insure a gas-tight seal to preclude excape of the precharge within the chamber 8 but when the unit 18 is unthreaded, as soon as the longitudinal passage 44 has been axially displaced enough to expose this passage beyond the outermost extent of the closure threads 29, the precharged gas within the chamber 8 will be bled therefrom and into the atmosphere, in a safe controlled manner until the pressure in the chamber 8 balances that of the atmosphere. After this point, continued removal of the unit 18 may be accomplished without any danger and after unit 18 is fully disconnected from the vessel 1, it follows that the closure 3 may be safety removed.

I claim:

1. A vessel including a body having an end opening and provided with an internal chamber adapted to contain pressurized gas, a closure spanning said end opening, means on said closure and body providing a removable gas-tight assembly of said closure to said body, said closure having an outer face and an opposite inner face juxtaposed said chamber, said closure provided with an axial gas passage therethrough, said outer face including tool-receiving means adapted to be engaged for disassembly of said closure from said body, a charging valve/cover plate unit having attachment means removably engaging said closure gas passage, said unit including a central gas charging valve and an affixed radially extending planar cover plate, said valve provided with a body having a planar inner face with said attachment means projecting therefrom, said cover plate including an inner surface adapted to overlie said closure tool-receiving means, means captively affixing said cover plate to said valve body with said cover plate inner surface substantially coplanar with said valve inner face, said attachment means comprising an externally threaded stem insertable within said closure gas passage, and means on said valve maintaining a gas-tight seal between said valve and closure when said stem is fully inserted within said gas passage with said valve inner face and cover plate inner surface juxtaposed said closure outer face whereby, removal of said unit from said closure initially relieves said gas-tight seal maintaining means to progressively release pressurized gas from said chamber through said passage to the atmosphere and subsequent total removal of said unit exposes said tool-receiving means to allow safe removal of said closure from said body.

2. A vessel according to claim 1 wherein, said gas-tight seal maintaining means includes, an annular resilient sealing element carried by said valve inner face.

3. A vessel according to claim 1 wherein, said gas-tight seal maintaining means includes a passage through the external threads of said stem.

4. A vessel according to claim 1 wherein, said affixing means comprises a shouldered recess in said valve adjacent said valve inner face, said cover plate having a central aperture provided with an inner periphery disposed within said recess, and means rigidly connecting said cover plate to said valve.

5. A vessel according to claim 1 wherein, said affixing means comprises a peripheral channel within said valve axially spaced from said valve inner face, said cover plate having a central aperture provided with an inner periphery disposed with said channel whereby said cover plate is angularly displaceable relative said valve.

6. A vessel according to claim 1 including, removable fasteners insertable through said cover plate into said closure intermediate said gas passage and body.

* * * * *